US009297583B2

(12) United States Patent
Baek et al.

(10) Patent No.: US 9,297,583 B2
(45) Date of Patent: Mar. 29, 2016

(54) LAUNDRY HANGER

(71) Applicant: INDUSTRY-ACADEMIC COOPERATION FOUNDATION YONSEI UNIVERSITY, Seoul (KR)

(72) Inventors: Yoon Su Baek, Seoul (KR); Jong Hyun Choi, Goyang-si (KR); Myung Hoon Sim, Seoul (KR); Dong Hee Ahn, Seoul (KR); Nu Ri Seo, Gwacheon-si (KR)

(73) Assignee: INDUSTRY-ACADEMIC COOPERATION FOUNDATION YONSEI UNIVERSITY, Seoul (KR)

( * ) Notice: Subject to any disclaimer, the term of this patent is extended or adjusted under 35 U.S.C. 154(b) by 424 days.

(21) Appl. No.: 13/975,304

(22) Filed: Aug. 24, 2013

(65) Prior Publication Data

US 2014/0053425 A1 Feb. 27, 2014

(30) Foreign Application Priority Data

Aug. 24, 2012 (KR) ..... 10-2012-0093101

(51) Int. Cl.

| | |
|---|---|
| ***F26B 25/04*** | (2006.01) |
| ***A47G 25/14*** | (2006.01) |
| ***D06F 59/02*** | (2006.01) |
| ***D06F 58/12*** | (2006.01) |
| ***D06F 57/00*** | (2006.01) |

(Continued)

(52) U.S. Cl.

CPC ..... *F26B 25/04* (2013.01); *A47G 25/14* (2013.01); *D06F 57/00* (2013.01); *D06F 57/12* (2013.01); *D06F 58/12* (2013.01); *D06F 59/02* (2013.01); *D06F 57/08* (2013.01)

(58) Field of Classification Search

CPC ..... A47G 25/14–25/52; D06F 58/10; D06F 58/12; D06F 58/14; D06F 59/02

See application file for complete search history.

(56) References Cited

U.S. PATENT DOCUMENTS 3,739,496 A * 6/1973 Buckley ..... D06F 73/02 312/271
8,938,834 B2 * 1/2015 Kim ..... D06F 73/02 8/158

(Continued)

FOREIGN PATENT DOCUMENTS

JP 2008-220800 A 9/2008
KR 10-2010-0026550 A1 3/2010

(Continued)

OTHER PUBLICATIONS

KIPO Notice of Allowance for Korean Application No. 10-2012-0093101 which corresponds to the above-identified U.S. Application.

*Primary Examiner* — David J Laux
(74) *Attorney, Agent, or Firm* — LRK Patent Law Firm

(57) ABSTRACT

Disclosed is a laundry drying rack. The laundry drying rack in accordance with an embodiment of the present invention includes a plurality of fixing hangers disposed in parallel to each other on a drying rack frame on which laundry is hung, a plurality of oscillating links each performing a swing motion with respect to each fixing hanger as a pivot axis, a plurality of oscillating hangers each connected to a lower end of the oscillating link and shaking the laundry, hung on the fixing hanger, at the bottom of the corresponding fixing hanger, a driving unit generating power, and an electric unit providing the power generated by the driving unit as an oscillating force for the oscillating links.

9 Claims, 5 Drawing Sheets

(51) Int. Cl.
*D06F 57/12* (2006.01)
*D06F 57/08* (2006.01)

(56) References Cited

U.S. PATENT DOCUMENTS 9,074,313 B2 * 7/2015 Kim ..... D06F 73/02
2006/0037209 A1 * 2/2006 Johnson ..... D06F 73/02 34/90

FOREIGN PATENT DOCUMENTS

KR 10-2012-0033034 A 4/2012
KR 10-2012-0087628 A 8/2012

* cited by examiner

LAUNDRY HANGER

CROSS-REFERENCE TO RELATED PATENT APPLICATION

This application claims the benefit of Korean Patent Application No. 10-2012-0093101, filed on Aug. 24, 2012, in the Korean Intellectual Property Office, the disclosure of which is incorporated herein in its entirety by reference.

BACKGROUND OF THE INVENTION

1. Field of the Invention

The present invention relates to a laundry drying rack and, more particularly, to a laundry drying rack, which can shake the laundry hung thereon from side to side, thus reducing the time required to completely dry the laundry.

2. Description of the Related Art

Most conventional laundry drying racks are designed to simply hang the laundry thereon to be naturally dried. Therefore, in the rainy season with high humidity and low sunshine, it takes a considerable time to dry the laundry, and this delay in drying time causes sanitary problems due to bacterial growth, thus deteriorating the indoor environment due to offensive odors.

Korean Patent Publication No. 10-2010-0026550 discloses an "automatic laundry drying device" designed to solve the above problems by reducing the laundry drying time. The automatic laundry drying device disclosed in the above patent literature is characterized in that a blower (i.e., drying fan) is provided at the bottom of the drying device to artificially provide dry air to the laundry hung on a drying member.

However, according to the above technique, when the blower is operated to dry the laundry, the dust on the floor rises with the wind generated by the blower and moves to the laundry, thus making the laundry dirty, and such a simple blowing method is not of much help to the reduction of drying time.

SUMMARY OF THE INVENTION

The present invention has been made in an effort to solve the above-described problems associated with prior art, and an object of the present invention is to provide a laundry drying rack which is electrically operated to artificially shake the laundry hung thereon, thus reducing the time required for drying and preventing the laundry from getting dirty.

Another object of the present invention is to provide a laundry drying rack, which is electrically operated to artificially shake the laundry and can be folded for storage during non-use.

To solve the above objects, the present invention provides a laundry drying rack comprising: a plurality of fixing hangers disposed in parallel to each other on a drying rack frame on which laundry is hung; a plurality of oscillating links each performing a swing motion with respect to each fixing hanger as a pivot axis; a plurality of oscillating hangers each connected to a lower end of the oscillating link and shaking the laundry, hung on the fixing hanger, at the bottom of the corresponding fixing hanger; a driving unit generating power; and an electric unit providing the power generated by the driving unit as an oscillating force for the oscillating links, wherein an upper free end of each oscillating link is an electric end receiving the oscillating, force from the electric unit with respect to the pivot axis of the fixing hanger and the electric ends of the respective oscillating links are inclined in the same direction.

In this embodiment, the oscillating links may be provided on both ends of each fixing hanger to be paired left and right, and the electric ends of the oscillating links, located in the left or right row among the plurality of oscillating links which are paired left and right, may be connected to the driving unit by means of the electric unit.

Moreover, the electric unit may comprise: a slider integrally connecting the electric ends of the oscillating links spaced apart in a direction that the laundry shakes; a cam and a crank mounted between the slider and an rotational axis of the driving unit; and a connecting pin connecting the cam and the crank.

Here, the cam may comprise a ring-shaped pin-connecting portion which is open in the rotational direction at an eccentric position spaced apart from the center of the cam, and the crank may be formed on one end of the slider and may comprise an elongated hole through which the connecting pin moves up and down when the rotational motion of the cam is converted into linear motion of the slider.

Moreover, for the implementation of foldable oscillating hangers including the oscillating links, the linear distance from the pivot axis of the fixing hanger to the lower end of the corresponding oscillating link may preferably be shorter than the horizontal distance between the oscillating links such that when a force is applied to the electric ends of the oscillating link in a pushing direction, the oscillating links can be disposed substantially parallel to the installation surface.

In this embodiment, the driving unit may be an electric motor whose rotational speed can be controlled, and the laundry drying rack may comprise a load detection sensor which outputs a command to stop the operation of the driving unit or an overcurrent circuit breaker which cuts off the current supply to the driving unit such that the laundry drying rack can be immediately stopped when a user's finger or laundry is caught between the oscillating links, which perform a swing motion, due to carelessness.

The fixing hanger and the oscillating hanger may have a hollow pipe shape with injection holes or slit-type injection nozzles and may further comprise a blower providing dry air to the inside of the hollow fixing hanger and oscillating hanger.

In this case, the amount of dry air provided by the blower may preferably be controlled for each step by the user's selection.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, exemplary embodiments of the present invention will be described in detail with reference to the accompanying drawings.

Figure 1:
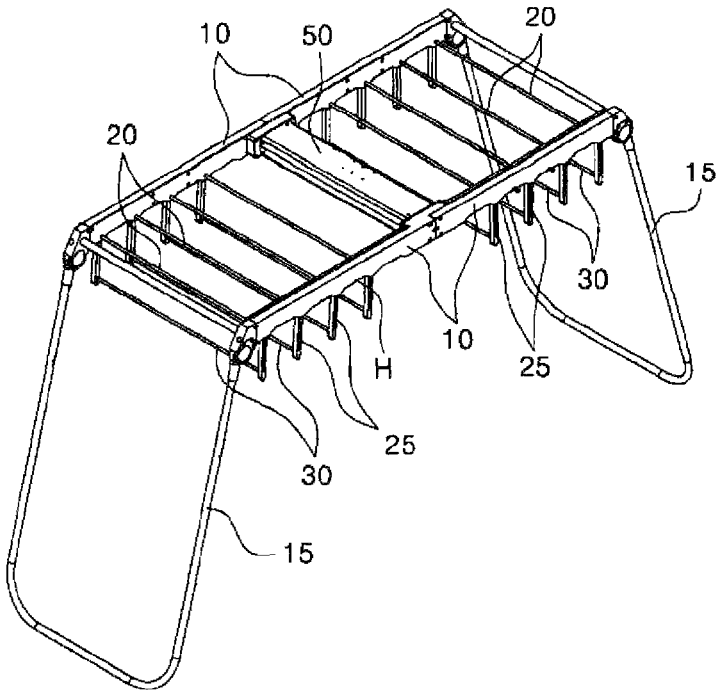
FIG. 1 is a perspective view of a laundry drying rack in accordance with an exemplary embodiment of the present invention.

FIG. 1 is a perspective view of a laundry drying rack in accordance with an exemplary embodiment of the present invention. The overall configuration of a laundry drying rack according to the present invention will be schematically described with reference to FIG. 1.

Referring to FIG. 1, a laundry drying rack in accordance with an exemplary embodiment of the present invention comprises a drying rack frame 10 which forms the overall framework. The drying rack frame 10 may be stably located at a height from the ground through a pair of foldably connected supports 15, and as shown in FIG. 1, a pair of drying rack frames 10 may be symmetrically provided with a control box 50 interposed therebetween.

A plurality of fixing hangers 20, on which the laundry is substantially hung, may be provided in parallel at regular intervals between the drying rack frames 10. Both ends of each fixing hanger 20 may be rotatably connected to the drying rack frames 10, an oscillating hanger 30 is disposed below and in parallel to each fixing hanger 20, and the fixing hanger 20 and the oscillating hanger 30 may be connected to each other by means of a pair of oscillating links 25.

The oscillating links 25 perform a swing motion (i.e., pendulum motion) in forward and backward directions within a predetermined angle range with respect to the fixing hanger 20 as a pivot axis on the drying rack frames 10. Accordingly, the oscillating hanger 30 connected to the bottom of the oscillating links 25 and disposed below and in parallel to the fixing hanger 20 shakes the laundry, hung on the fixing hanger 20, at the bottom of the corresponding fixing hanger 20.

The material and thickness of the drying rack frame 10, the fixing hanger 20, and the oscillating hanger 30 are not particularly limited as long as they have sufficient axial strength to prevent sagging or deformation thereof when laundry of a specific weight is hung thereon. Moreover, the structure and shape thereof are not limited to those shown in FIG. 1 as long as they can accommodate and dry much more laundry.

The driving force for the swing motion of the oscillating links 25 and the oscillating hangers 30 may be generated by a driving unit (not shown), e.g., an electric motor, provided in the control box 50 located in the middle of the drying rack. The power, specifically, the driving force generated by the driving unit is converted into linear reciprocating motion by means of an electric unit 40 and provided as an oscillating force for moving the oscillating links 25. The configuration of the laundry drying rack according to the present invention will be described in more detail below.

Figure 2:
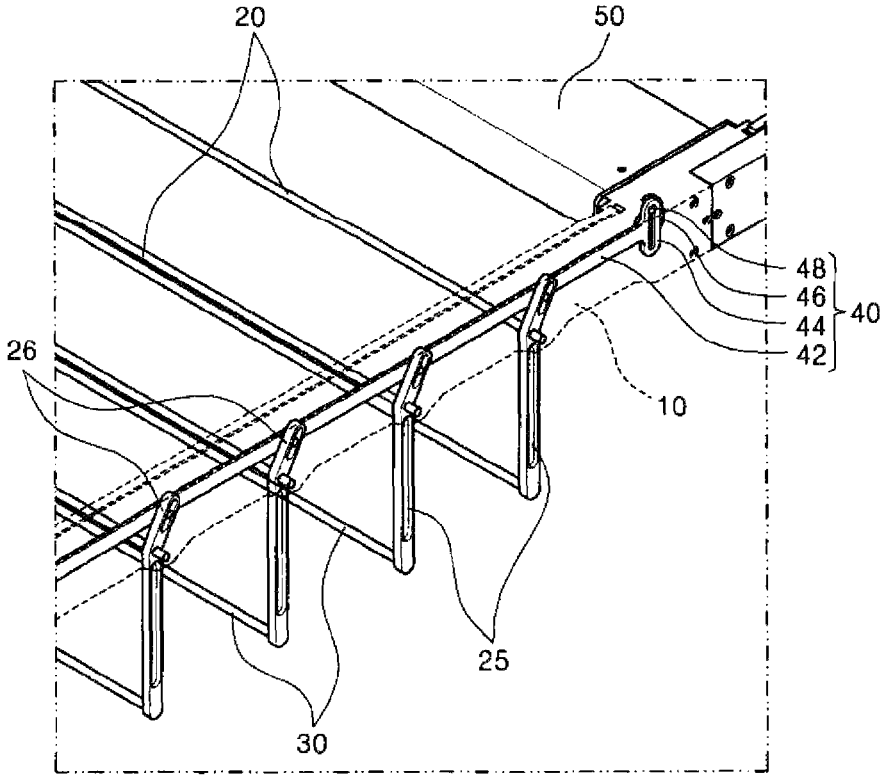
FIG. 2 is an enlarged perspective view of a plurality of oscillating links of a laundry drying rack in accordance with an exemplary embodiment of the present invention.
Figure 3:
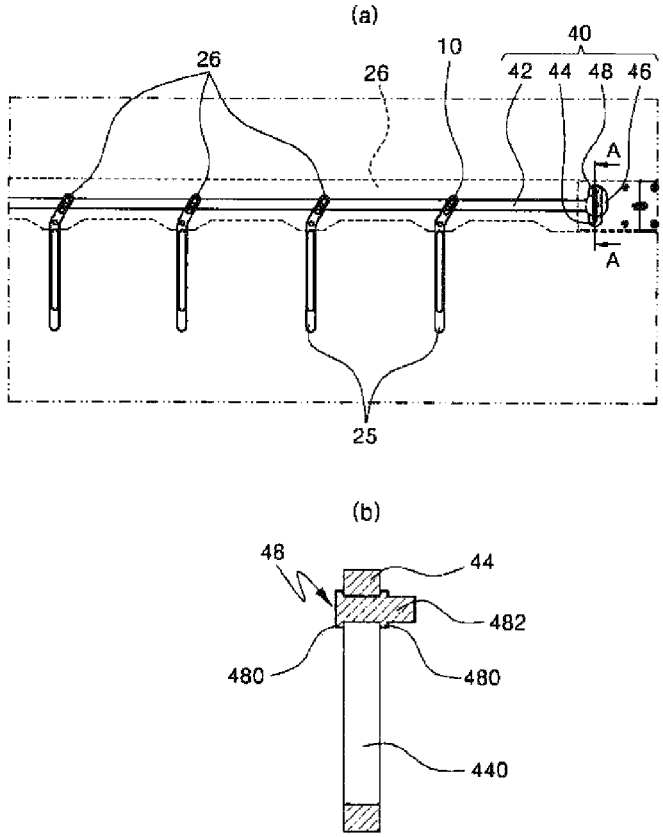
FIG. 3 is a front view of the laundry drying rack shown in FIG. 2.

FIG. 2 is an enlarged perspective view of a plurality of oscillating links of a laundry drying rack in accordance with an exemplary embodiment of the present invention, and FIG. 3 is a front view of the laundry drying rack shown in FIG. 2.

Referring to FIGS. 2 and 3, the oscillating links 25 which perform a swing motion may be opposite to each other on both ends of each fixing hanger 20 to be paired left and right, and each pair of adjacent oscillating links 25 is spaced the same distance between adjacent fixing hangers 20. Here, an electric end 26 which receives the oscillating force from the electric unit 40 may be integrally formed on the top of each oscillating link 25 with respect to the pivot axis (i.e., fixing hanger 20).

The electric ends 26 of the respective oscillating links 25 may have an elongated hole for connection to a slider 42, which will be described later, and may be inclined in the same direction. The electric ends 26 of the oscillating links 25, located in the left or right row among the plurality of oscillating links 25 which are paired left and right, are connected to the driving unit by means of a single electric unit 40 so as to transmit the power, and thus several pairs of oscillating links 25 can be moved at the same time by the movement of the electric unit 40.

The electric unit 40 may preferably comprise a slider 42 which integrally connects the electric ends 26 of the oscillating links 25 located in the left or right row, a cam 46 and a crank 46 which are mounted between the slider 42 and the driving unit, specifically, a rotational axis of the electric motor, and a connecting pin 48 which connects the crank 44 and the cam 46.

The cam 46 may preferably comprise a ring-shaped pin-connecting portion 47 which is open in the rotational direction at an eccentric position spaced apart from the center of the cam 46. The crank 44 may preferably comprise an elongated hole 440 formed vertically such that when the rotational motion of the cam 46 is converted into linear motion of the slider 42, only the horizontal component of the force transmitted to the crank 44 can be transmitted through the connecting pin 48.

The connecting pin 48 moves up and down along the elongated hole 440 during power transmission and is detachably inserted into the ring-shaped pin-connecting portion 47 to transmit the power to the cam 46 and the crank 44. Therefore, as shown in (b) of FIG. 3, the connecting pin 48 may have a structure, in which a connecting end 482 detachably inserted into the pin-connecting portion 47 is integrally formed on one end thereof, based on a rivet shape in which a head 480 having a diameter greater than the width of the elongated hole is formed on both ends thereof.

Figure 4:
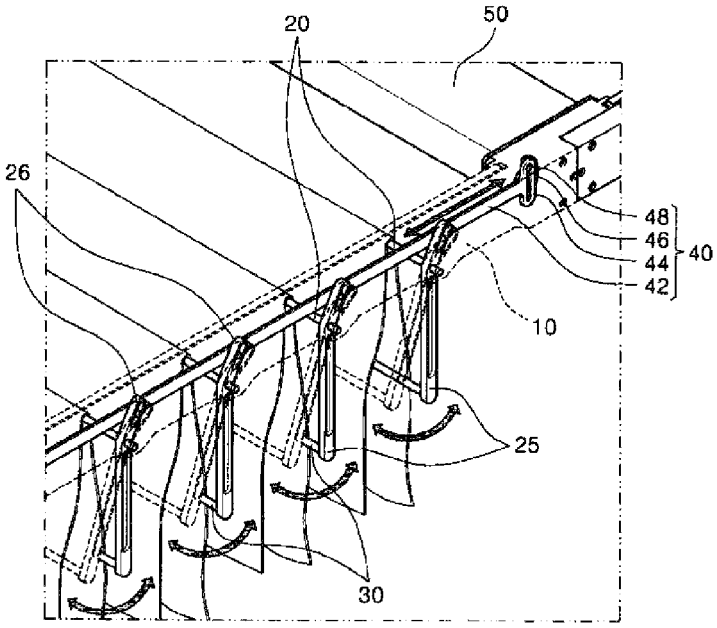
FIG. 4 is a view showing the operation of a major part the laundry drying rack in accordance with an exemplary embodiment of the present invention.

According to this configuration, as shown in FIG. 4, when the cam 46 is rotated in one direction by the rotation of the driving unit, the crank 44 which is electrically connected to the cam 45 by means of the connecting pin 48 oscillates in the horizontal direction, whose force is simultaneously transmitted to several oscillating links 25 disposed in a straight line through a single slider 42, and eventually the oscillating hangers 30 are moved by the swing motion of the oscillating links 25 with respect to the fixing hangers 20 as pivot axes.

Figure 5:
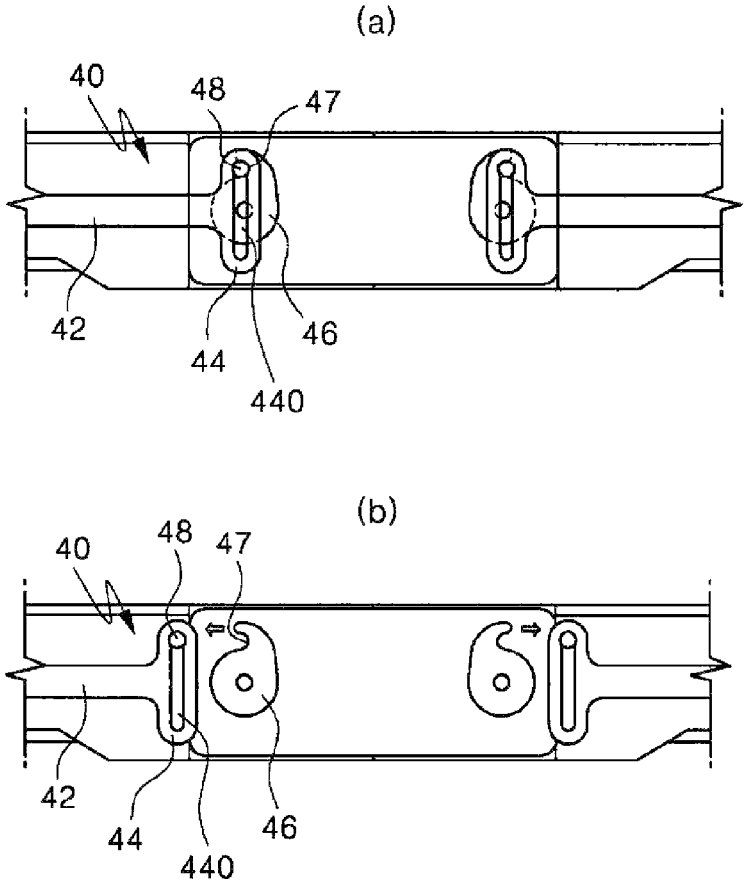
FIG. 5 is a view showing that a crack is disconnected from a cam in the laundry drying rack in accordance with an exemplary embodiment of the present invention.
Figure 6:
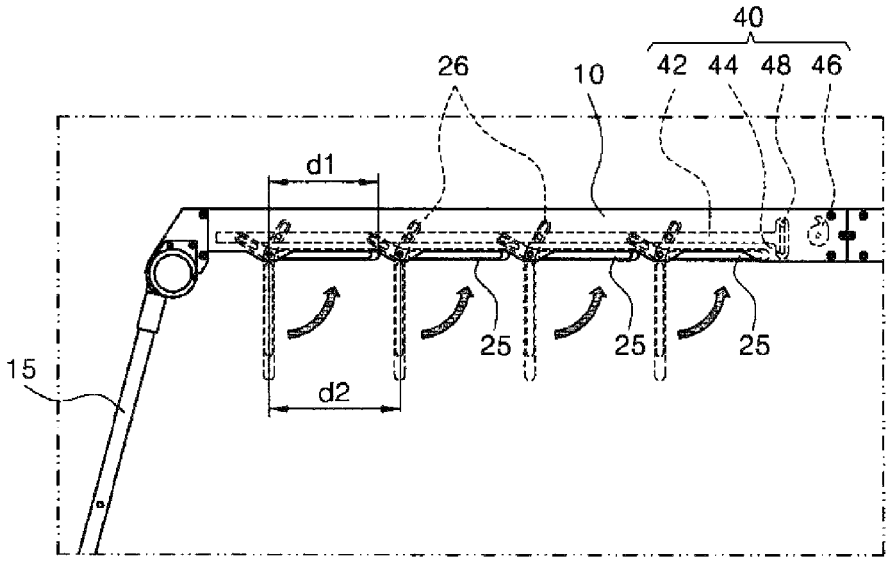
FIG. 6 is a view showing that several oscillating links are folded simultaneously by the operation of the crack disconnected from the cam.

FIG. 5 is a view showing that the crack is disconnected from the cam, and FIG. 6 is a view showing that several oscillating links 25 are folded simultaneously by the operation of the crack disconnected from the cam.

Referring first to FIG. 5, with the ring-shaped configuration of the pin-connecting portion 47 which is open in the rotational direction at an eccentric position from the center of the cam 46 as mentioned above, when the pin-connecting portion 47 is located at a specific position, for example, in the 12 o'clock direction as shown in the figure, the crank 44 can be disconnected from the cam 46, and eventually the oscillating links 25 can be folded in a form suitable for storage as shown in FIG. 6.

Figure 7:
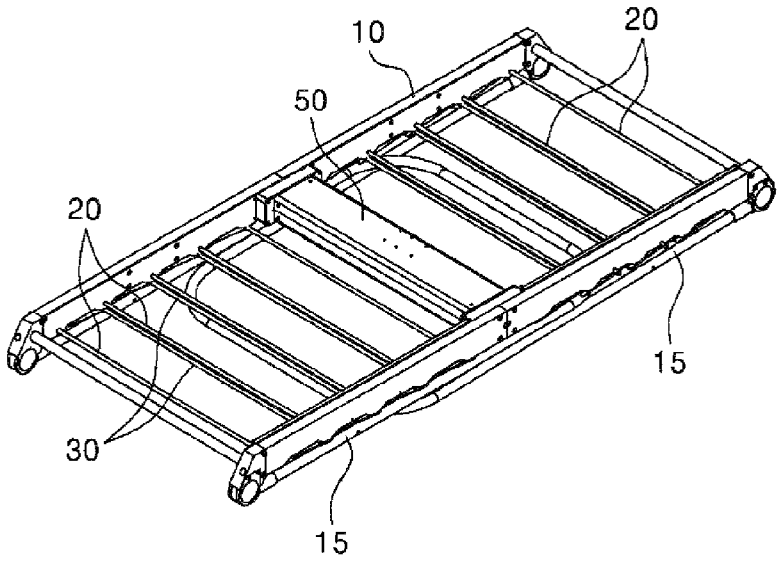
FIG. 7 is a perspective view showing a folded state of the laundry drying rack.

In other words, since the crank 44 and the slider 42 are connected and the oscillating links 25 in a straight line are integrally connected by the slider 42, when an external force is applied to any one of the oscillating links 25 in a state where the pin-connecting portion 47 of the cam 46 is located as shown in (a) of FIG. 5, the crank 44 is disconnected from the cam 46 as shown in (b) of FIG. 5 and, at the same time, the plurality of oscillating links 25 are disposed substantially parallel to the ground, thereby folding the laundry drying rack as shown in FIG. 7.

Here, the electric ends 26 formed in the respective oscillating links 25 are inclined in the same direction toward the crank 44 and the cam 46 connected to each other, and thus when the oscillating links 25 are folded in a form suitable for storage, the crank 44 can be naturally disconnected from the cam 46 by the manual folding of the oscillating links 25.

Moreover, if the oscillating links 25 are disposed substantially parallel to the installation surface after the manual folding of the oscillating links 25, the overall volume of the folded laundry drying rack can be reduced, which is more advantageous for storage.

Meanwhile, if the swing speed of the oscillating links that shake the laundry can be controlled, it is possible to reduce unnecessary power consumption and achieve optimal drying for each laundry material. Therefore, in the implementation of the laundry drying rack in accordance with an embodiment of the present invention, it is advantageous to configure the laundry drying rack such that the speed of the driving unit can be controlled by a user's manipulation, and to this end, a lever-type or button-type controller (not shown) may be employed.

Moreover, it is preferred that the operation of the driving unit 40 is automatically stopped when a load of more than a predetermined magnitude applied to the oscillating links 25 is detected, thus preventing the user's finger from being caught therebetween due to carelessness or preventing the occurrence of failure due to the laundry being caught therebetween during drying.

This can be achieved by employing a load detection sensor which outputs a command to stop the operation of the driving unit when a load of more than a predetermined magnitude is detected or an overcurrent circuit breaker which stops the driving unit by cutting off the current supply to the driving unit (motor) when the amount of current increases due to load.

Figure 8:
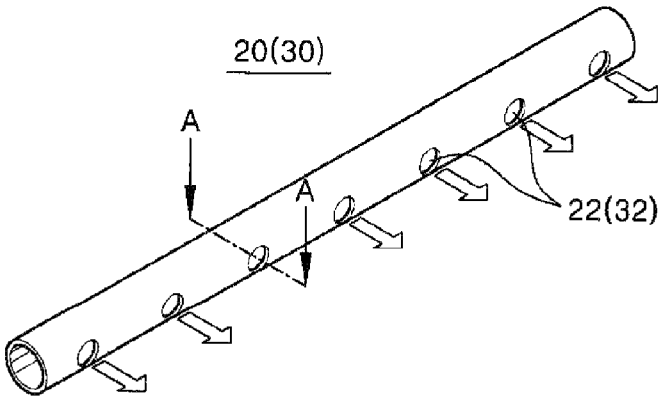
FIG. 8 is a perspective view of a fixing hanger (or oscillating hanger) applied in this embodiment.
Figure 9:
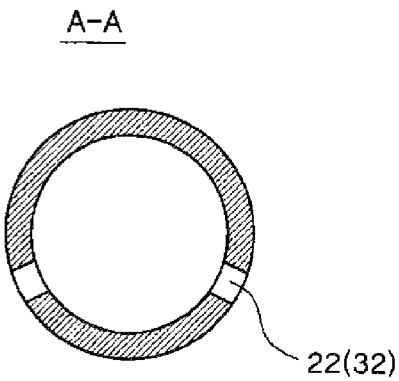
FIG. 9 is a cross-sectional view taken along line A-A of FIG. 8.
Figure 10:
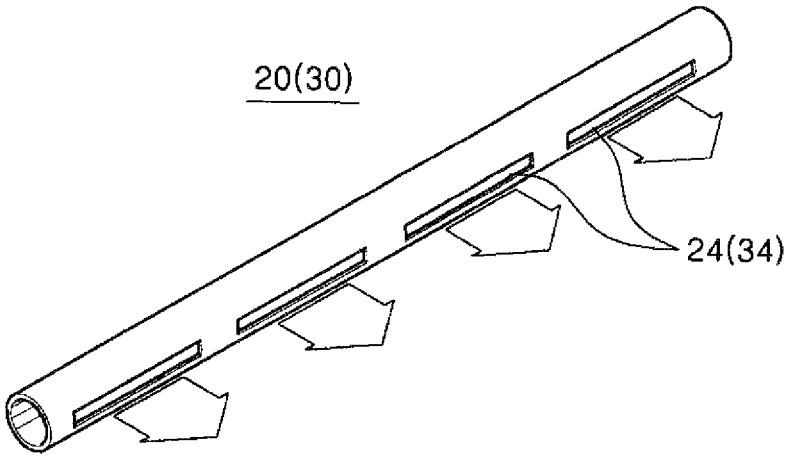
FIG. 10 is a perspective view of a fixing hanger (or oscillating hanger) in accordance with another embodiment of the present invention.

FIG. 8 is a perspective view of a fixing hanger (or oscillating hanger) applied in this embodiment, FIG. 9 is a cross-sectional view taken along line A-A of FIG. 8, and FIG. 10 is a perspective view of a fixing hanger (or oscillating hanger) in accordance with another embodiment of the present invention.

Referring to FIGS. 8 to 10, the fixing hanger 20 and/or the oscillating hanger 30 employed in this embodiment may have a hollow pipe shape with injection holes 22 and 32 (see FIG. 8) or slit-type injection nozzles 24 and 34, and the fixing hanger 20 and/or the oscillating hanger 30 may further comprise a blower (not shown) which provides dry air to the inside of the hallow fixing hanger 20 and/or oscillating hanger 30.

When the dry air generated by the blower is supplied to the laundry through the fixing hangers 20 and/or the oscillating hangers 30, it is possible to allow humid air on the surface of the laundry to flow by artificially shaking the laundry hung on the drying rack according to the above-mentioned swing operation and, at the same time, further reduce the time required to dry the laundry due to the injection of dry air.

When the amount of dry air provided by the blower can also be controlled for each step using the controller by the user's selection, it is possible to achieve optimal drying for each laundry material and, at the same time, reduce unnecessary power consumption. Therefore, it is preferred that the intensity of the blower can also be controlled by the user's manipulation.

As described above, according to the laundry drying rack in accordance with the embodiments of the present invention, unlike the conventional method of simply hanging the laundry to be naturally dried, it is possible to change the ventilation area by shaking the laundry hung on the drying rack and, at the same time, provide circulation of air by allowing humid air on the surface of the laundry to flow, thus drying the laundry in the same manner as the drying by the natural wind and thus significantly reducing the drying time.

Moreover, it is possible to control the swing speed of the oscillating drying rack, and thus it is possible to reduce unnecessary power consumption and achieve optimal drying for each laundry material. Moreover, according to the present invention, the laundry is directly shaken to dry, and thus the amount of foreign materials such as dust attached to the surface of the laundry can be significantly reduced, compared to the conventional laundry drying rack employing a blower for artificially raising the wind.

Furthermore, when the fixing hangers and the oscillating hangers, which constitute the drying rack, are formed into a hollow pipe shape such that dry air can be provided to the laundry, hung on the drying rack, through the respective hangers, it is possible to more rapidly dry the laundry even in the worst situation to dry the laundry, like the rainy season with high humidity and low sunshine. Moreover, the laundry drying rack according to the present invention can be electrically operated and can be folded, which is very advantageous for storage during non-use.

While the invention has been shown and described with reference to certain preferred embodiments thereof, it will be understood by those skilled in the art that various changes in form and details may be made therein without departing from the spirit and scope of the invention as defined by the appended claims. Therefore, the scope of the invention is defined not by the detailed description of the invention but by the appended claims, and all differences within the scope will be construed as being included in the present invention.

What is claimed is:

1. A laundry drying rack comprising:

a plurality of fixing hangers disposed in parallel to each other on a drying rack frame on which laundry is hung;

a plurality of oscillating links each performing a swing motion with respect to each fixing hanger as a pivot axis;

a plurality of oscillating hangers each connected to a lower end of the oscillating link and shaking the laundry, hung on the fixing hanger, at the bottom of the corresponding fixing hanger;

a driving unit generating power; and an electric unit providing the power generated by the driving unit as an oscillating force for the oscillating links, wherein an upper free end of each oscillating link is an electric end receiving the oscillating force from the electric unit with respect to the pivot axis of the fixing hanger and the electric ends of the respective oscillating links are inclined in the same direction.

2. The laundry drying rack of claim 1, wherein the oscillating links are provided on both ends of each fixing hanger to be paired left and right, and the electric ends of the oscillating links, located in the left or right row among the plurality of oscillating links which are paired left and right, are connected to the driving unit by means of the electric unit.

3. The laundry drying rack of claim 1 or 2, wherein the electric unit comprises:

a slider integrally connecting the electric ends of the oscillating links spaced apart in a direction that the laundry shakes;

a cam and a crank mounted between the slider and an rotational axis of the driving unit; and a connecting pin connecting the cam and the crank.

4. The laundry drying rack of claim 3, wherein the cam comprises a ring-shaped pin-connecting portion which is open in the rotational direction at an eccentric position spaced apart from the center of the cam, and wherein the crank is formed on one end of the slider and comprises an elongated hole through which the connecting pin moves up and down when the rotational motion of the cam is converted into linear motion of the slider.

5. The laundry drying rack of claim 1, wherein the linear distance from the pivot axis of the fixing hanger to the lower end of the corresponding oscillating link, is shorter than the horizontal distance between the oscillating links.

6. The laundry drying rack of claim 1, wherein the driving unit is an electric motor whose rotational speed can be controlled.

7. The laundry drying rack of claim 1, further comprising a load detection sensor which outputs a command to stop the operation of the driving unit or an overcurrent circuit breaker which cuts off the current supply to the driving unit, when a load of more than a predetermined magnitude applied to the oscillating links is detected.

8. The laundry drying rack of claim 1, wherein the fixing hanger and the oscillating hanger have a hollow pipe shape with injection holes or slit-type injection nozzles and further comprise a blower providing dry air to the inside of the hollow fixing hanger and oscillating hanger.

9. The laundry drying rack of claim 8, wherein the amount of dry air provided by the blower can be controlled for each step.

* * * * *